US009255764B2

(12) United States Patent
Park

(10) Patent No.: US 9,255,764 B2
(45) Date of Patent: Feb. 9, 2016

(54) CROSSBOW

(71) Applicant: No Youn Park, Incheon (KR)

(72) Inventor: No Youn Park, Incheon (KR)

( * ) Notice: Subject to any disclaimer, the term of this patent is extended or adjusted under 35 U.S.C. 154(b) by 0 days.

(21) Appl. No.: 14/418,376

(22) PCT Filed: Aug. 9, 2013

(86) PCT No.: PCT/KR2013/007220
§ 371 (c)(1),
(2) Date: Jan. 29, 2015

(87) PCT Pub. No.: WO2014/051257
PCT Pub. Date: Apr. 3, 2014

(65) Prior Publication Data

US 2015/0260478 A1 Sep. 17, 2015

(30) Foreign Application Priority Data

Sep. 27, 2012 (KR) ..... 10-2012-0108102

(51) Int. Cl.
*F41B 7/00* (2006.01)
*F41B 7/04* (2006.01)
*F41B 5/12* (2006.01)
*F41B 3/00* (2006.01)

(52) U.S. Cl.
CPC ..... *F41B 7/003* (2013.01); *F41B 3/005* (2013.01); *F41B 5/12* (2013.01); *F41B 7/04* (2013.01)

(58) Field of Classification Search
CPC ..... F41B 7/04; F41B 3/005; F41B 5/12; F41B 7/003
USPC ..... 124/17, 20.3, 22, 25, 27
See application file for complete search history.

(56) References Cited

U.S. PATENT DOCUMENTS 1,261,992 A * 4/1918 Algie ..... F41B 3/005 124/21
2,638,885 A * 5/1953 Keadle ..... F41B 3/005 124/20.1
3,006,330 A * 10/1961 De Bach ..... F41B 7/04 124/22
3,509,863 A * 5/1970 Barker ..... F41B 7/003 124/16
4,169,456 A * 10/1979 Van House ..... F41B 5/12 124/25
4,593,673 A * 6/1986 Kees ..... F41B 3/005 124/20.3
4,703,744 A * 11/1987 Taylor ..... F41B 3/02 124/20.1
4,942,861 A * 7/1990 Bozek ..... F41B 5/12 124/25
5,025,771 A * 6/1991 Hanson ..... F41B 5/1469 124/25
5,243,955 A * 9/1993 Farless ..... F41B 3/005 124/20.1
5,355,866 A * 10/1994 Hunter ..... F41B 7/003 124/16
5,372,118 A * 12/1994 Schmidt, III ..... F41B 7/04 124/20.3
5,595,166 A * 1/1997 Schmidt, III ..... F41B 7/04 124/20.3

(Continued)

FOREIGN PATENT DOCUMENTS

EP 1024340 8/2000
KR 20-1994-0001613 1/1994

(Continued)

*Primary Examiner* — Alexander Niconovich
(74) *Attorney, Agent, or Firm* — IPLA P.A.; James E. Bame

(57) ABSTRACT

A crossbow includes a bowstring for firing an arrow combined therewith in the lengthwise direction of the crossbow body so as to be manufactured in a structure that does not have a bow on the crossbow body. Thus, carrying convenience can be provided, and at the same time, the maximum effective range of the crossbow can be adjusted by adjusting the tension of the bowstring.

11 Claims, 13 Drawing Sheets

(56) References Cited

U.S. PATENT DOCUMENTS 5,642,723 A * 7/1997 Hogan ..... F41B 7/003 124/20.3
5,649,520 A * 7/1997 Bednar ..... F41B 5/12 124/25
5,649,521 A * 7/1997 King ..... F41B 5/12 124/25
5,931,145 A * 8/1999 Oviedo-Reyes ..... F41B 5/12 124/20.3
6,273,078 B1 * 8/2001 Schwesinger ..... F41B 5/12 124/16
6,895,950 B2 * 5/2005 Gillet ..... F41B 7/04 124/20.3
6,953,034 B2 * 10/2005 May ..... A01K 81/00 124/17
7,926,474 B2 * 4/2011 Berry ..... A01K 81/06 124/20.3
8,312,869 B2 * 11/2012 Gillet ..... A01K 81/00 124/20.3
8,387,602 B1 * 3/2013 Bruington ..... F41B 7/04 124/20.3
8,485,170 B1 * 7/2013 Prior ..... F41B 5/123 124/25
8,567,376 B2 * 10/2013 Flint ..... F41B 5/12 124/20.3
8,607,773 B1 * 12/2013 Schultz ..... F41B 5/123 124/25
8,863,732 B1 * 10/2014 Prior ..... F41B 5/123 124/25
9,052,154 B1 * 6/2015 Prior ..... F41B 5/123
2004/0074484 A1 * 4/2004 Gillet ..... F41B 7/04 124/23.1

FOREIGN PATENT DOCUMENTS

KR 2003662510000 10/2004
KR 1020110086534 7/2011

* cited by examiner

CROSSBOW

BACKGROUND

The present invention relates to a crossbow used for leisure and hunting and, more particularly, to a crossbow which has a bowstring for firing an arrow combined with the body of the crossbow in the lengthwise direction thereof and which is fabricated to have a structure not having a bow in the body of the crossbow in order to provide the carrying convenience of the crossbow and to control a maximum effective range of the crossbow by controlling the elasticity of a bowstring.

In general, a crossbow is an apparatus for putting an arrow on a firing device having a wood stick form and firing the arrow and is an improved weapon having a longer range of fire and stronger penetration power than a common bow. The crossbow has a basic structure in which a groove for determining the direction of an arrow and a device for firing the arrow are combined at the center of the firing device. In modern times, the materials and structure of the crossbow have been variously improved and used for hunting and leisure.

"Korean Utility Model No. 20-0226759 (Mar. 29, 2001)" was disclosed as such a crossbow. Such a crossbow is configured to include a housing added to the front of a main body to which an arrow track, an aiming unit, a trigger, are added, a compression piece opened and closed by a hinge at the top of a mounting groove provided in the housing, an opening and closing means formed of a handle and a clamper for fixing and releasing the compression piece, and a clamping nut for fixing a rim frame inserted into the compression piece.

In such a conventional crossbow, the rim frame can be combined with and separated from a mounting unit easily and rapidly because the compression piece that is opened and closed up and down is added to the front of the main body, and the main body and the rim frame can be separated and kept in a case for portability, thereby enabling the crossbow to be easily used.

However, the conventional crossbow has a disadvantage in that the rim frame having a string combined with a rim must be used in order to fire an arrow. Furthermore, the conventional crossbow is problematic in that production costs are increased in fabricating the crossbow because the rim that generates tension for firing an arrow is made of expensive materials having high strength and high elasticity properties and it is inconvenient to use the crossbow because the rim frame must be combined with and separated from the main body of the crossbow.

Furthermore, the conventional crossbow has disadvantages in that it is impossible to hit the mark exceeding a maximum effective range of the crossbow because an arrow is fired using some elasticity of the rim and the string and that it becomes more difficult to load an arrow on the string if the maximum effective range of the crossbow is increased by increasing the elasticity of the rim and string of the crossbow. As a result, the conventional crossbow is problematic in that the maximum effective range of the crossbow is limited.

SUMMARY OF THE INVENTION

An object of the present invention that has been made to solve problems, such as those described above, is to provide an improved crossbow in which an arrow track capable of pulling a bowstring is combined with the body of the crossbow in front thereof in its lengthwise direction and the crossbow is fabricated to have a structure in which an arrow is fired using the elasticity of the bowstring put over the arrow track, thereby simplifying the structure of the crossbow and enhancing the carrying convenience of the crossbow.

Furthermore, another object of the present invention is to provide an improved crossbow whose maximum effective range can be optionally controlled by a user by controlling the elasticity of a bowstring in such a way as to forward and backward move an arrow track combined with the front part of the body of the crossbow.

Technical Solution

In accordance with an aspect of the present invention for accomplishing the above objects, a crossbow according to the present invention includes a body which is formed in a gun form and in which a latch protrusion connected to a trigger and moved up and down is installed at the center within the body, the trigger connected to the body through coupling shafts protruded on both sides of the lower part of the latch protrusion moves the latch protrusion up and down, a handle is integrated with the body in the rear of the trigger and protruded from the body, and fixing rollers are combined with the ends of the front part of the trigger; an arrow track in which a fixing pipe is inserted into the upper end of the front of the body and combined with the body, a control pipe is combined with the fixing pipe so that the control pipe slides within the fixing pipe forward and backward, and a pair of front rollers is combined with the respective ends of the front part of the control pipe; a projectile in which a latching hole is formed so that the projectile is hung on the latch protrusion of the body, a bowstring is connected to the front of the projectile, and a latching strap hung on a latching hook formed in the arrowhead of an arrow is formed in the rear of the projectile; and the bowstring which is combined with the fixing rollers of the body through the front rollers of the arrow track from the projectile and which fires the projectile toward the front of the body when the trigger works.

Furthermore, roller coupling plates with which the front rollers are combined are combined with the front of the control pipe of the arrow track, and a guide ring and a loading ring are combined with the respective upper and lower parts of the front parts of the roller coupling plates.

Furthermore, the control pipe includes elastic members having one ends combined with insertion holes that are inserted into both sides of the control pipe and formed in the control pipe and elastic protrusions combined with the other ends of the elastic members and elastically supported by the elastic members so that the elastic protrusions are inserted into the insertion holes and externally protruded from the control pipe. Fixing holes into which the elastic protrusions are inserted are formed to penetrate the fixing pipe on both sides of the fixing pipe. When the control pipe slides within the fixing pipe, the elastic protrusions are inserted into the fixing holes and the control pipe is fixed to the fixing pipe.

Furthermore, range control divisions 226 are formed on the side of the control pipe.

Furthermore, a loading plate is combined with the upper part of the rear of the body so that the arrow shaft of the arrow is inserted into the loading plate.

Furthermore, a safety device is inserted into the lower part of the latch protrusion of the body and combined with the latch protrusion in such a way as to operate within the body backward and forward so that the safety device blocks a space to which the latch protrusion comes down and the latch protrusion is prevented from moving downward.

Furthermore, the improved crossbow further includes a protection plate provided on one side of the side of the body and upward bent from the body.

Furthermore, a scope is fit into one side of the lower part of the protection plate and combined with the protection plate.

Furthermore, the improved crossbow further includes a cover plate including the upper plate and the lower plate at the lower part of the fixing pipe of the arrow track.

Furthermore, a coupling pin having both ends separated is coupled with the center of the fixing rollers and the front rollers. The coupling pin is fixed to the fixing rollers and the front rollers when the coupling pin is dissembled and assembled through a spiral coupling method.

Furthermore, the bowstring is divided into a first part, a second part, and a third part. The first part is fixed to the fixing rollers. The second part is extended on the front rollers. The third part is fixed to the front of the projectile and combined with the projectile.

Furthermore, the areas of the first part, the second part, and the third part when the first, the second, and the third parts are cut in a vertical plane in a lengthwise direction of the bowstring are fabricated to be different.

Furthermore, the bowstring has a smaller area from the first part to the third part.

Advantageous Effects

As described above, in accordance with the present invention, the arrow track capable of pulling the bowstring is combined with the body of the crossbow in front thereof in the lengthwise direction of the body and the crossbow is also fabricated to have a structure in which an arrow is fired using the elasticity of the bowstring put over the arrow track. Accordingly, an improved crossbow having enhanced carrying convenience can be provided because the structure of the crossbow is simplified.

Furthermore, in accordance with the present invention, there can be provided an improved crossbow whose maximum effective range can be optionally controlled by a user by controlling the elasticity of a bowstring in such a way as to forward and backward move an arrow track combined with the front part of the body of the crossbow.

DESCRIPTION OF REFERENCE NUMERALS

Figure 1:
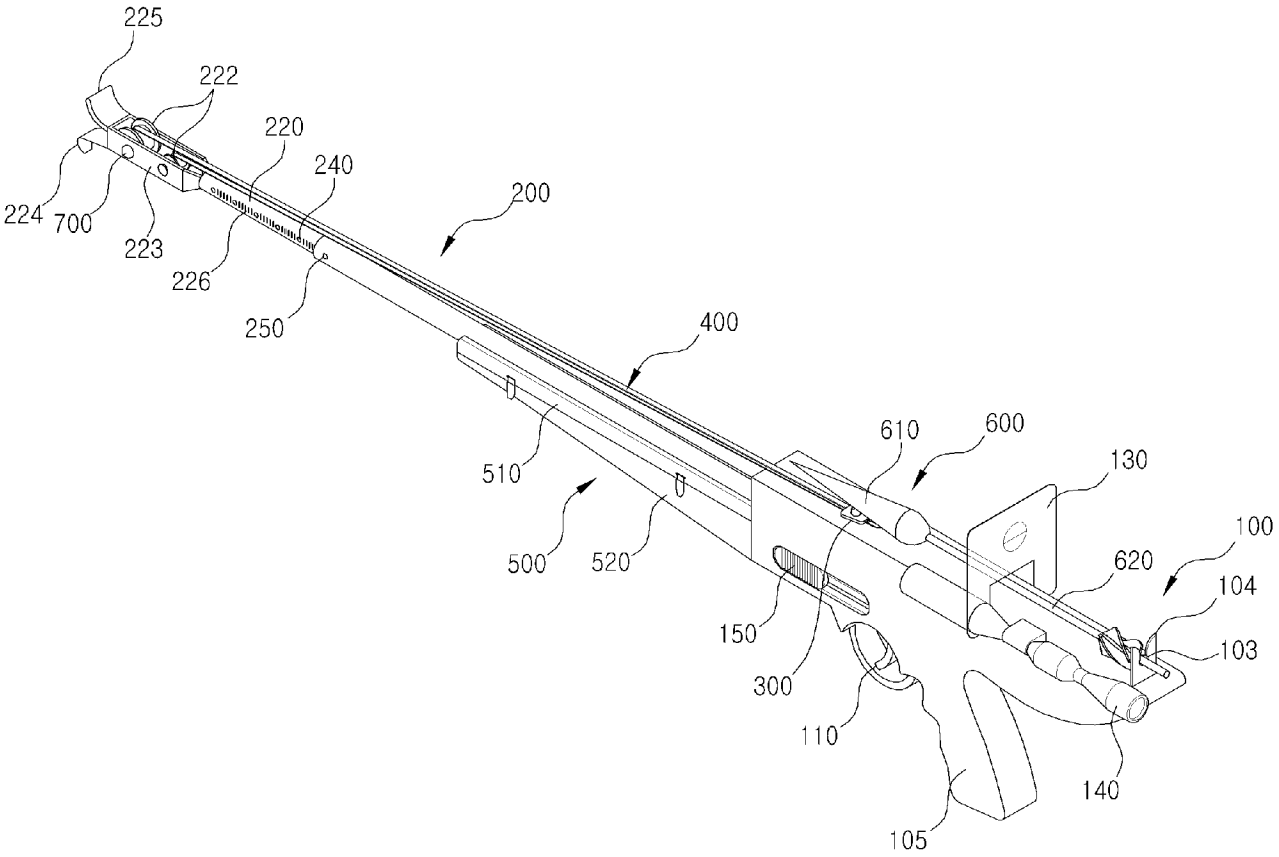
FIG. 1 is a perspective view illustrating an improved crossbow in accordance with a first preferred embodiment of the present invention.

100: body 101: compartment 102: fastening hole
103: insertion hole 104: loading plate 105: handle
110: trigger 111: coupling ring 112: hinge shaft
120: latch protrusion 121: coupling shaft 122: spring
130: protection plate 140: scope 150: safety device
200: the arrow track 210: fixing pipe 220: control pipe
222: front roller 223: roller coupling plate 224: loading ring
225: guide ring 230: elastic member 240: elastic protrusion
250: fixing hole 260: insertion hole 300: projectile
310: latching hole 320: latching strap 400: bowstring
500: cover plate 510: upper plate 520: lower plate
600: arrow 610: arrowhead 611: latching hook
620: arrow shaft 700: coupling pin

DETAILED DESCRIPTION OF THE INVENTION

The merits and characteristics of the present invention and a method for achieving the merits and characteristics will become more apparent from embodiments described in detail later in conjunction with the accompanying drawings. However, the present invention is not limited to the disclosed embodiments, but may be implemented in various different ways. The embodiments are provided to only complete the disclosure of the present invention and to allow those skilled in the art to understand the category of the present invention. The present invention is defined by the category of the claims. The same reference numbers will be used to refer to the same or similar parts throughout the drawings.

The present invention is described with reference to the drawings for illustrating an improved crossbow in connection with the embodiments of the present invention.

Figure 2:
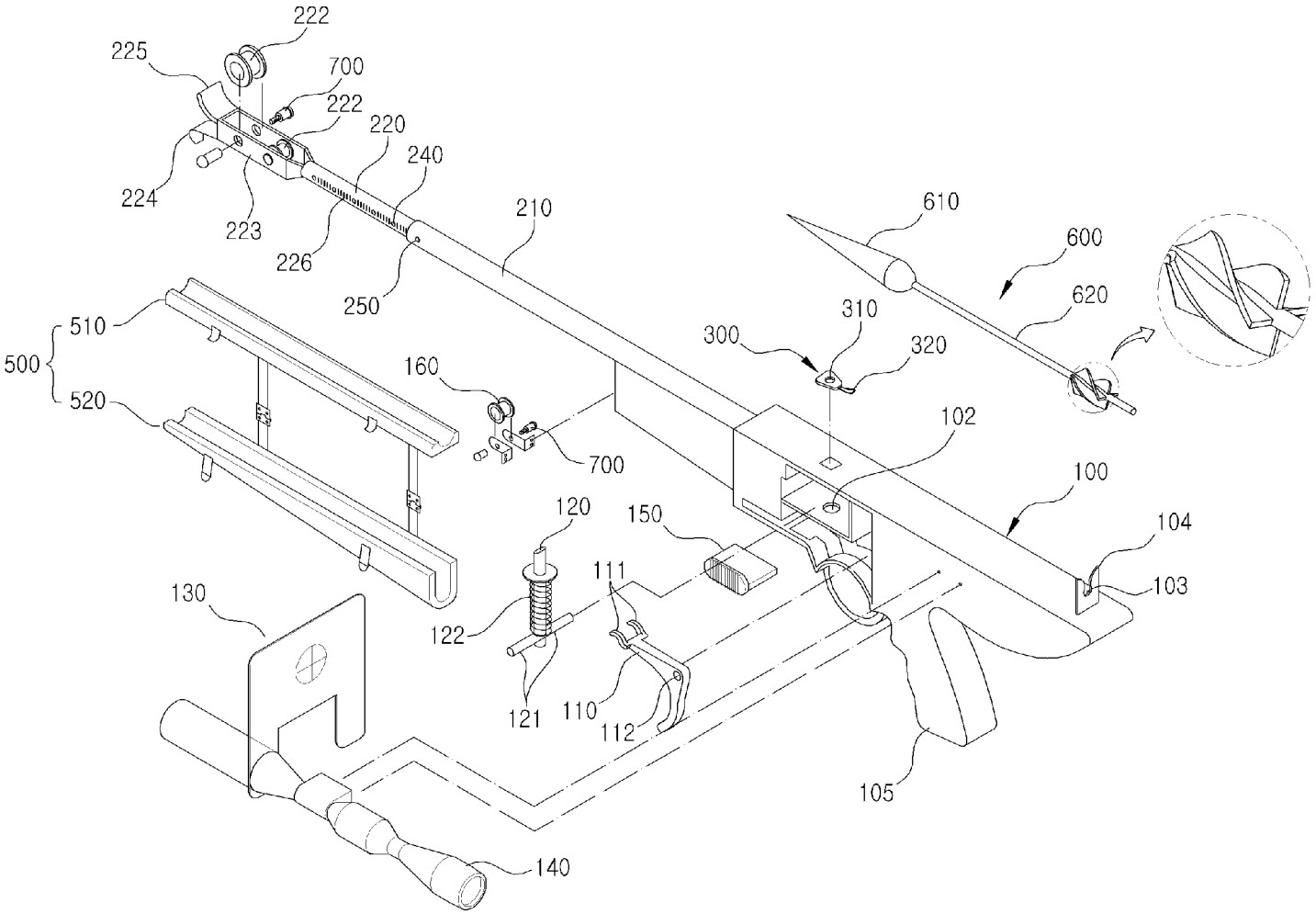
FIG. 2 is an exploded perspective view illustrating the improved crossbow in accordance with the first preferred embodiment of the present invention.
Figure 3:
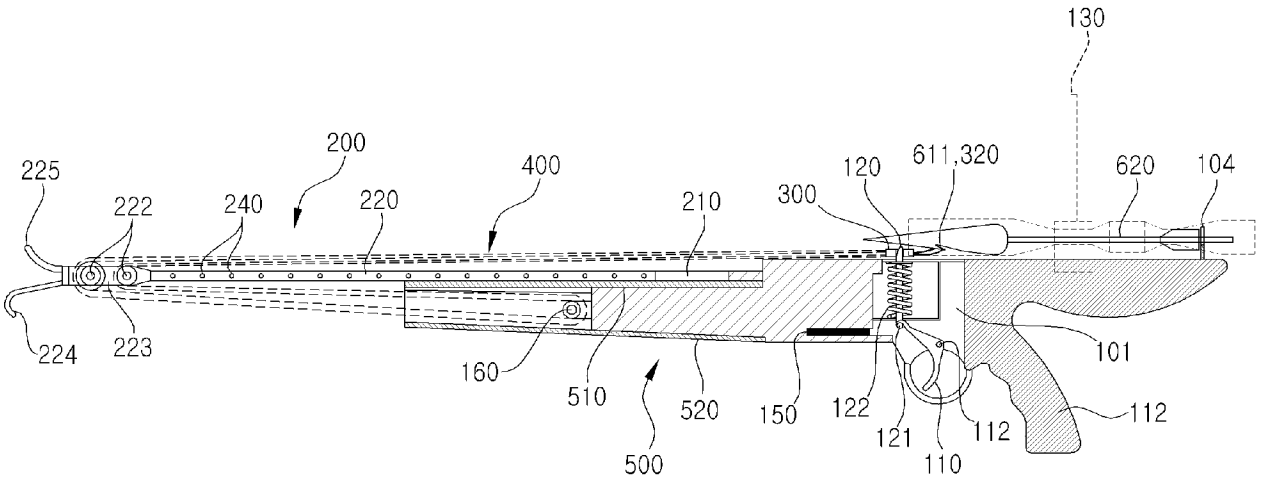
FIG. 3 is a cross-sectional view illustrating the improved crossbow in accordance with the first preferred embodiment of the present invention.
Figure 4:
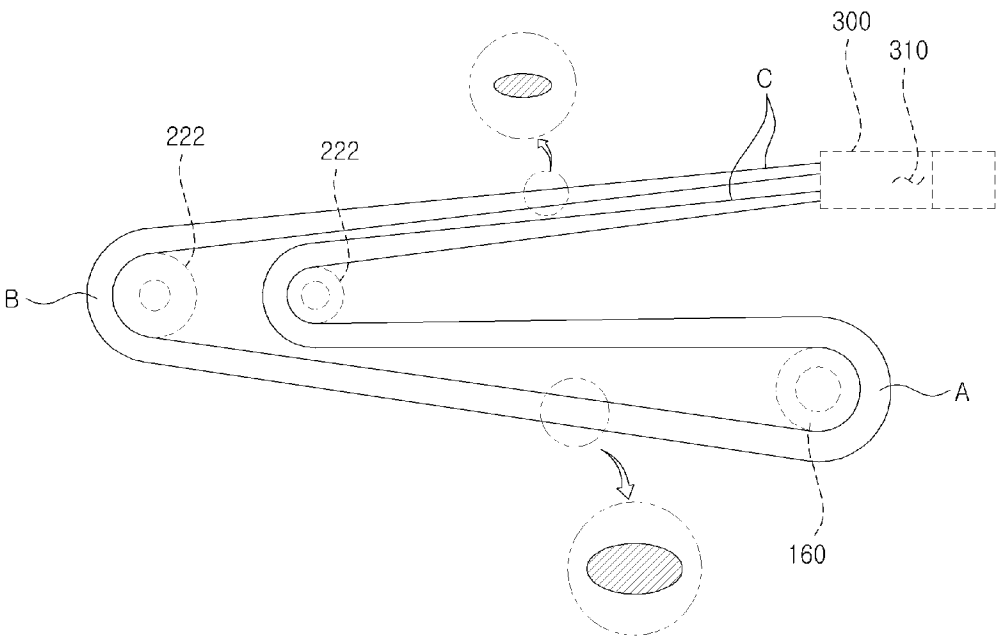
FIG. 4 is a side view illustrating the bowstring of the improved crossbow in accordance with the first preferred embodiment of the present invention.

FIG. 1 is a perspective view illustrating an improved crossbow in accordance with a first preferred embodiment of the present invention. FIG. 2 is an exploded perspective view illustrating the improved crossbow in accordance with the first preferred embodiment of the present invention. FIG. 3 is a cross-sectional view illustrating the improved crossbow in accordance with the first preferred embodiment of the present invention. FIG. 4 is a side view illustrating the bowstring of the improved crossbow in accordance with the first preferred embodiment of the present invention.

Referring to FIGS. 1 to 4, first, a body 100 is formed to have a specific length in a gun form.

That is, a general shape of the body 100 is the same as that of the body of a common crossbow. The body 100 has a basic body shape of a conventional crossbow in which a handle 105 is formed at the bottom of the body, and it is made of wood or synthetic resin materials.

Furthermore, a latch protrusion 120 is combined with the body 100 toward the inside of the body on one side of the upper part of the body 100 in such a way to be upwardly protruded.

The latch protrusion 120 has a cylindrical shape. Coupling shafts 121 are formed on one side of the lower part of the latch protrusion 120 in such a way as to be protruded on both sides of the latch protrusion 120.

Furthermore, a spring 122 for applying elasticity to the latch protrusion 120 is combined with the upper part of the coupling shafts 121.

In this case, the latch protrusion 120 is combined with the body 100 in such a way as to be upwardly protruded from the body 100 by means of the elasticity of the spring 122.

Furthermore, the latch protrusion 120 is combined with a compartment 101 formed within the body 100. The latch protrusion 120 is inserted into a fastening hole 102 formed to penetrate the body on one side of the center of the compartment 101 in such a way as to vertically move up and down.

Meanwhile, a trigger 110 for moving the latch protrusion 120 up and down is combined with the latch protrusion 120 so that it is connected to the latch protrusion 120 on one side of the lower part of the body 100.

Coupling rings 111 are formed on both sides of the trigger 110 on one side of the upper part of the trigger 110.

The coupling rings 111 are combined with the coupling shafts 121 at the lower part of the latch protrusion 120.

A hinge shaft 112 is formed on the other side of the upper part of the trigger 110. Furthermore, the hinge shaft 112 is combined with one side of the lower part of the body 100, and the trigger 110 moves around the hinge shaft 112.

In this case, when the trigger 110 is combined with one side of the lower part of the body 100, the coupling rings 111 of the trigger 110 are coupled with the respective coupling shafts 121 of the latch protrusion 120 in such a way as to be engaged therewith. Furthermore, when a user pulls the trigger 110 backward, the trigger 110 moves around the hinge shaft 112, and thus the coupling rings 111 of the trigger 110 lower the latch protrusion 120 downward. Furthermore, when a user releases a force that pulls the trigger 110, the latch protrusion 120 returns to the original state by means of the spring 122 combined with the latch protrusion 120.

An arrow track 200 includes a fixing pipe 210 and a control pipe 220.

The fixing pipe 210 is inserted into the end of the upper part of the body 100 at the front of the body 100 and combined therewith.

Furthermore, the fixing pipe 210 has a circular pipe form having a specific length. A part on one side of the fixing pipe 210 is inserted into the front part of the body 100 and firmly fixed thereto.

The control pipe 220 is combined with the inside of the fixing pipe 210 in such a way as to slide forward and backward.

Furthermore, the control pipe 220 is fabricated to have the same inside diameter as the fixing pipe 210 and may slide forward and backward without shaking when it is inserted into the fixing pipe 210.

Furthermore, a pair of front rollers 222 is combined with the respective ends of the control pipe 220 at the front thereof so that they pull a bowstring 400.

That is, since the control pipe 220 is inserted into the fixing pipe 210 and is able to slide forward and backward, the bowstring 400 is pulled to the maximum extent depending on the protrusion length of the control pipe 220 and is able to maximize the tension of the bowstring 400.

Figure 11:
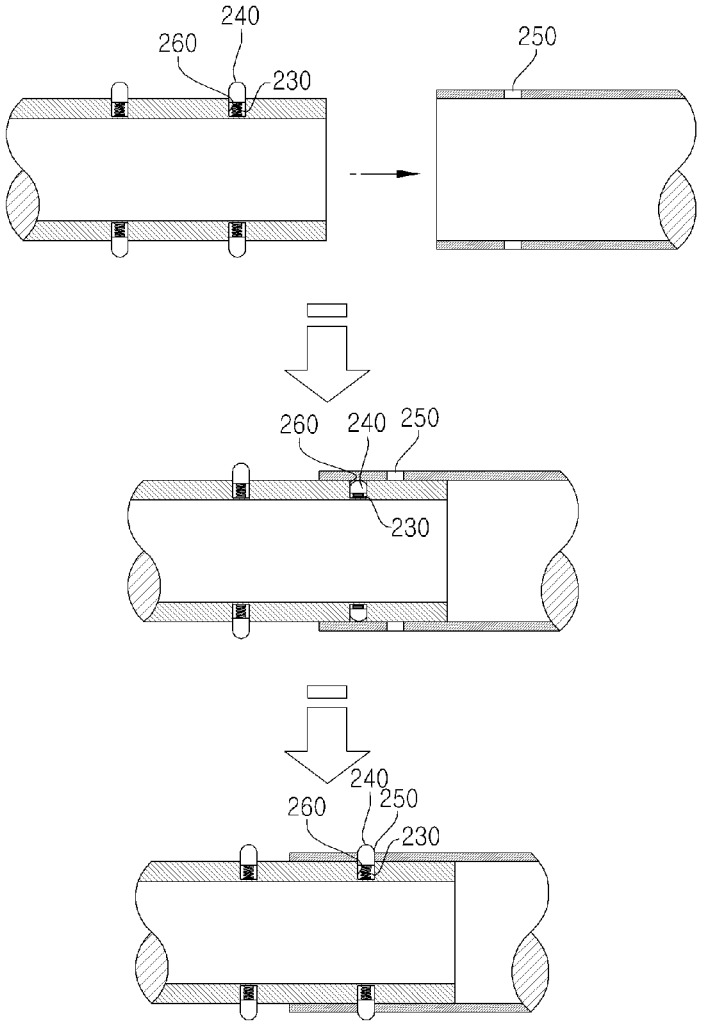
FIG. 11 is a cross-sectional view illustrating that the length of the arrow track of the improved crossbow in accordance with the first preferred embodiment of the present invention has been controlled.

FIG. 11 is a cross-sectional view illustrating that the length of the arrow track of the improved crossbow in accordance with the first preferred embodiment of the present invention has been controlled.

Referring to FIG. 11, elastic members 230 that have respective one ends combined with insertion holes 260 concaved and formed on both sides and elastic protrusions 240 that are combined with the other ends of the elastic members 230 and elastically supported by the elastic members 230 in such a way as to be concaved into the insertion holes 260 and outward protruded from the control pipe 220 are formed in the control pipe 220.

Furthermore, fixing holes 250 into both sides of which the elastic protrusions 240 are inserted are formed to penetrate the fixing pipe 210.

That is, when the control pipe 220 slides within the fixing pipe 210, the elastic protrusions 240 are inserted into the fixing holes 250 and thus the control pipe 220 is fixed to the fixing pipe 210.

Furthermore, when the elastic protrusions 240 are pressed by a user in the state in which the elastic protrusions 240 have been inserted into the fixing holes 250, the elastic protrusions 240 are inserted into the insertion holes 260 and simultaneously pulled out from the fixing holes 250. At this time, the control pipe 220 is able to slide in the state in which it has been inserted into the fixing pipe 210 and is deep inserted into the fixing pipe 210 or externally protruded. Accordingly, the length of the arrow track 200 is controlled.

As described above, the arrow track 200 in which the control pipe 220 slides within the fixing pipe 210 forward and backward is provided in order to increase or decrease the tension of the bowstring 400 engaged with the crossbow 1.

Furthermore, range control divisions 226 in which the range of the crossbow 1 according to the tension of the bowstring 400 are marked by divisions may be formed on one side or both sides of the control pipe 220 of the arrow track 200.

Accordingly, a user who uses the crossbow 1 may control the tension of the bowstring 400 by moving the position of the control pipe 220 while checking the range control divisions 226 with the naked eye.

In this case, the pair of front rollers 222 is coupled with the end of the control pipe 220 between roller coupling plates 223 combined in a "⊏" shape and is extended in the respective strings of the bowstring 400.

Furthermore, a guide ring 225 is combined with the front part of the roller coupling plates 223 on the upper side of the roller coupling plates 223. A loading ring 224 having a hook shape is combined with the lower part of the roller coupling plates 223.

A latching hole 310 is formed in the projectile 300 so that the projectile 300 is engaged with the latch protrusion 120 of the body 100. The bowstring 400 is connected to the front of the projectile 300, and a latching strap 320 is formed at the back of the projectile 300.

In this case, when the bowstring 400 is connected to the projectile 300, the bowstring 400 is connected to the projectile 300 in the state in which the bowstring 400 formed of two strings becomes vertical (refer to FIG. 4).

The latching strap 320 is a strap engaged with a latching hook 611 formed in the arrowhead 610 of an arrow 600.

Furthermore, a loading plate 104 is formed at the top of the body 100 so that the arrow 600 is fixed at the top of the body 100.

That is, the loading plate 104 is combined with the top of the body 100 in the rear of the body 100. An insertion hole 103 is formed in the loading plate 104 so that the arrow shaft 620 of the arrow 600 is inserted into the insertion hole 103.

In the crossbow 1, the bowstring 400 functions as a medium for firing the arrow 600.

Such a bowstring 400 is made of rubber materials having high elasticity. The end of one side of the bowstring 400 is connected to the projectile 300, and the other side of the bowstring 400 is fixed to the fixing rollers 160 of the body 100 through the front rollers 222 of the arrow track 200.

That is, when a user forward pulls the control pipe 220 of the arrow track 200, the bowstring 400 is extended along the control pipe 220, thus having increased elasticity. On the contrary to this, the control pipe 220 of the arrow track 200 slides into the fixing pipe 210 at the back of the control pipe 220 and is inserted therein, thus having reduced elasticity.

Meanwhile, a protection plate 130 formed to bend toward the top of the body 100 is combined with one side of the side of the body 100.

The protection plate 130 is protection means for preventing a broken bowstring 400 from hitting a user when the bowstring 400 is used for a long time and broken.

Furthermore, the protection plate 130 preferably is made of transparent acryl or glass materials, and a separate aiming point (not illustrated) may be printed on a surface of the protection plate 130.

Furthermore, a separately fabricated scope 140 is combined with one side of the lower part of the protection plate 130 so that precise aiming through the scope 140 is made possible.

Furthermore, a safety device 150 is combined with the bottom of the latch protrusion 120 of the body 100.

The safety device 150 is combined with the latch protrusion 120 so that is slides within the body 100 forward and backward. Furthermore, if a user does not use the crossbow 1, the safety device 150 is placed in a space to which the latch protrusion 120 comes down by backward pulling the safety device 150 for safety. In this case, although a user unintentionally pulls the trigger 110, the crossbow 1 does not fire an arrow because the latch protrusion 120 clogged by the safety device 150 does not come down.

Meanwhile, a cover plate 500 consisting of an upper plate 510 and a lower plate 520 is combined with the lower part of the fixing pipe 210 of the arrow track 200.

The cover plate 500 is provided in order for a user to hold the crossbow 1 more safely.

The lower plate 520 and the upper plate 510 are hinged and combined with each other using hinges (not illustrated) formed on one sides of the lower and upper plates. The other sides of the lower and upper plates are combined with each other using locking devices (not illustrated) capable of fixing the lower plate 520 and the upper plate 510.

That is, when the bowstring 400 is replaced, the lower plate 520 is separated from the upper plate 510 by releasing the hinges and the locking devices, and the bowstring 400 combined with the fixing rollers 160 is disassembled by opening the lower plate 520.

In this case, a coupling pin 700 having both sides separated is coupled to the center of the fixing rollers 160 and the front rollers 222.

The coupling pin 700 functions to more facilitate the disassembly and assembly of the fixing rollers 160 and the front rollers 222, and it may be disassembled and assembled through a spiral coupling method.

Furthermore, the coupling pin 700 includes a part, that is, a nut part, on one side and a part, that is, a bolt part, on the other side. The nut and bolt parts of the coupling pin 700 are combined with each other.

Furthermore, if the bowstring 400 is broken while a user uses the crossbow 1, the bowstring 400 may be easily replaced by separating the fixing rollers 160 and the front rollers 222 using the coupling pin 700. Furthermore, when the bowstring 400 is replaced, the projectile 300 is also replaced.

Meanwhile, the bowstring 400 is divided into a first part A, a second part B, and a third part C as illustrated in FIG. 4.

The first part A is a part combined with the fixing rollers 160, the second part B is a part extended on the front rollers 222, and the third part C is a part combined with the projectile 300.

If the bowstring 400 is used for a long time, the bowstring 400 may be broken.

In this case, if the broken portion of the bowstring 400 is distant from the body 100, a safety accident may occur because the broken portion bounces back to a user. Accordingly, the bowstring 400 is fabricated so that the first part A of the bowstring 400, that is, a part closest to the crossbow 1, is broken.

That is, the areas of the first part A, the second part B, and the third part C when the first, the second, and the third parts are cut in a vertical plane in the lengthwise direction of the bowstring 400 are fabricated to be different.

In this case, the bowstring 400 preferably has a smaller area from the first part A to the third part C.

Accordingly, the bowstring 400 is fabricated so that the first part A having the smallest area and a thin thickness is more easily broken than the second part B and the third part C. As a result, the bowstring 400 bounces forward without bouncing back to a user's body, that is, to the rear of the body 100.

Figure 5:
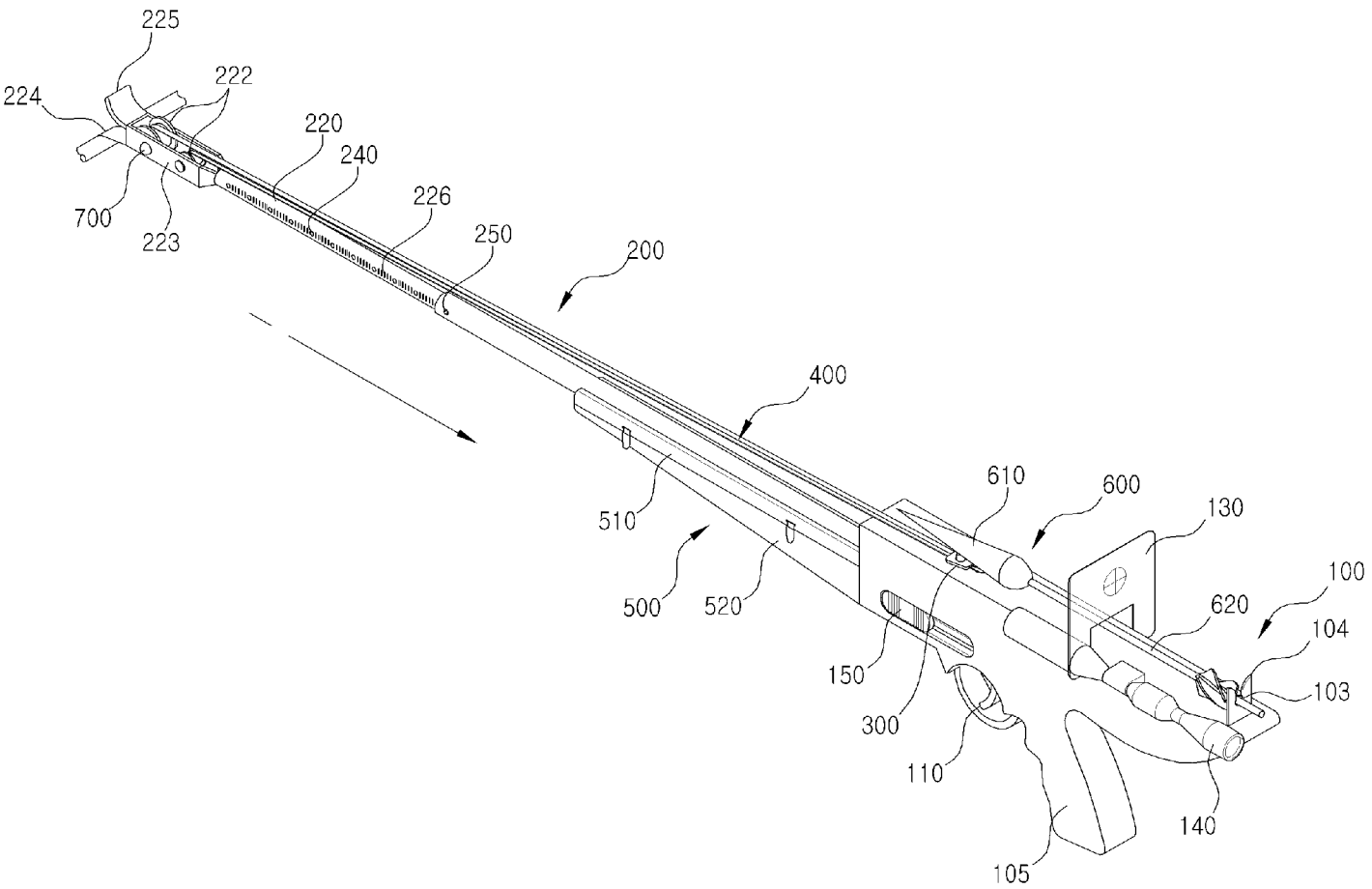
FIGS. 5 and 6 are state diagrams illustrating the state in which the improved crossbow in accordance with the first preferred embodiment of the present invention is used.
Figure 6:
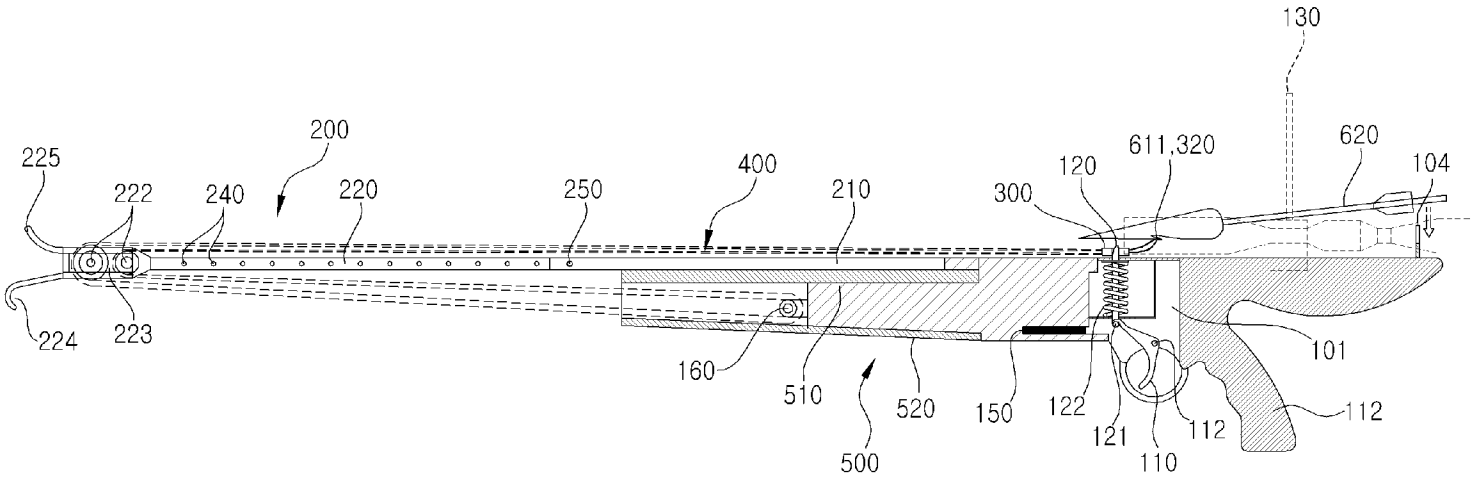

FIGS. 5 and 6 are state diagrams illustrating the state in which the improved crossbow in accordance with the first preferred embodiment of the present invention is used.

The state in which the crossbow according to the present invention is used is described below with reference to FIGS. 5 and 6.

First, FIG. 5 illustrates the state in which the bowstring 400 of the crossbow 1 has been pulled. It is not easy for a user to directly pull the bowstring 400 of the crossbow 1 due to elasticity. For this reason, a user pushes the control pipe 220 of the crossbow 1 into the fixing pipe 210 to the maximum extent and then combines the projectile 300 of the crossbow 1 with the latch protrusion 120 of the body 100.

Furthermore, the loading ring 224 combined with the front of the control pipe 220 of the arrow track 200 is hung on a bough or a pipe on the roadside.

Furthermore, a user pulls the body 100 backward while holding the handle 105 at the lower part of the body 100 using one hand and also holding the cover plate 500 using the other hand.

Accordingly, the bowstring 400 is extended, thereby generating tension.

At this time, as the elastic protrusions 240 are inserted into the fixing holes 250, the control pipe 220 is fixed to the fixing pipe 210.

Furthermore, FIG. 6 illustrates the state in which the arrow 600 is loaded on the crossbow 1 in which tension has been generated in the bowstring 400.

The projectile 300 is combined with the latch protrusion 120 and fixed to the top of the body 100. Furthermore, the latching strap 320 formed in the projectile 300 is hung on the latching hook 611 formed in the arrowhead 610 of the arrow 600.

At the same time, the arrow shaft 620 of the arrow 600, that is, the end of the rear of the arrow shaft 620, is inserted into the insertion hole 103 of the loading plate 104 formed at the top of the body 100 so that the arrow 600 is seated in the top of the body 100 of the crossbow 1 and loaded thereon.

Figure 7:
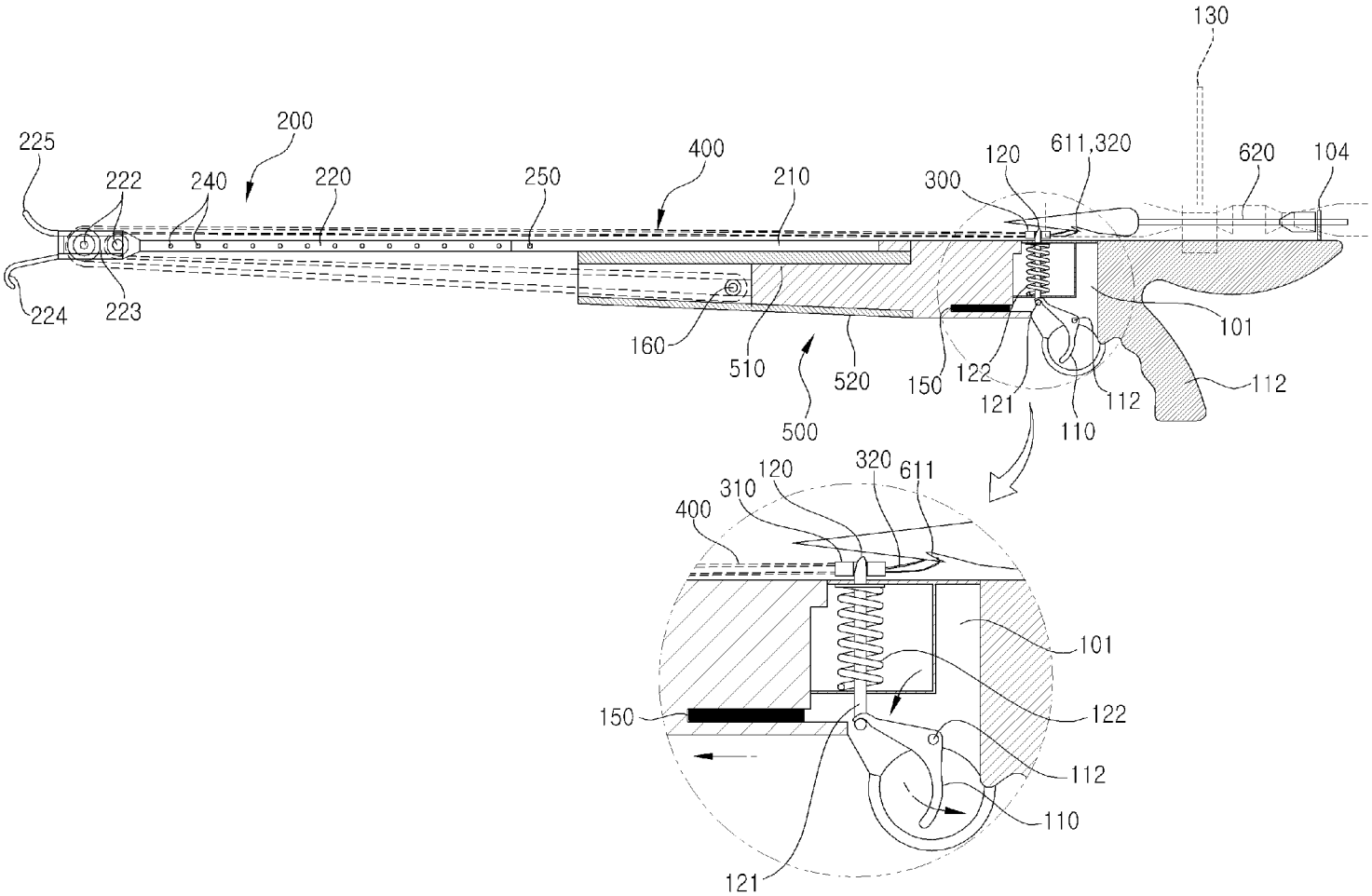
FIGS. 7 and 8 are diagrams illustrating the state in which the arrow of the improved crossbow in accordance with the first preferred embodiment of the present invention is fired.
Figure 8:
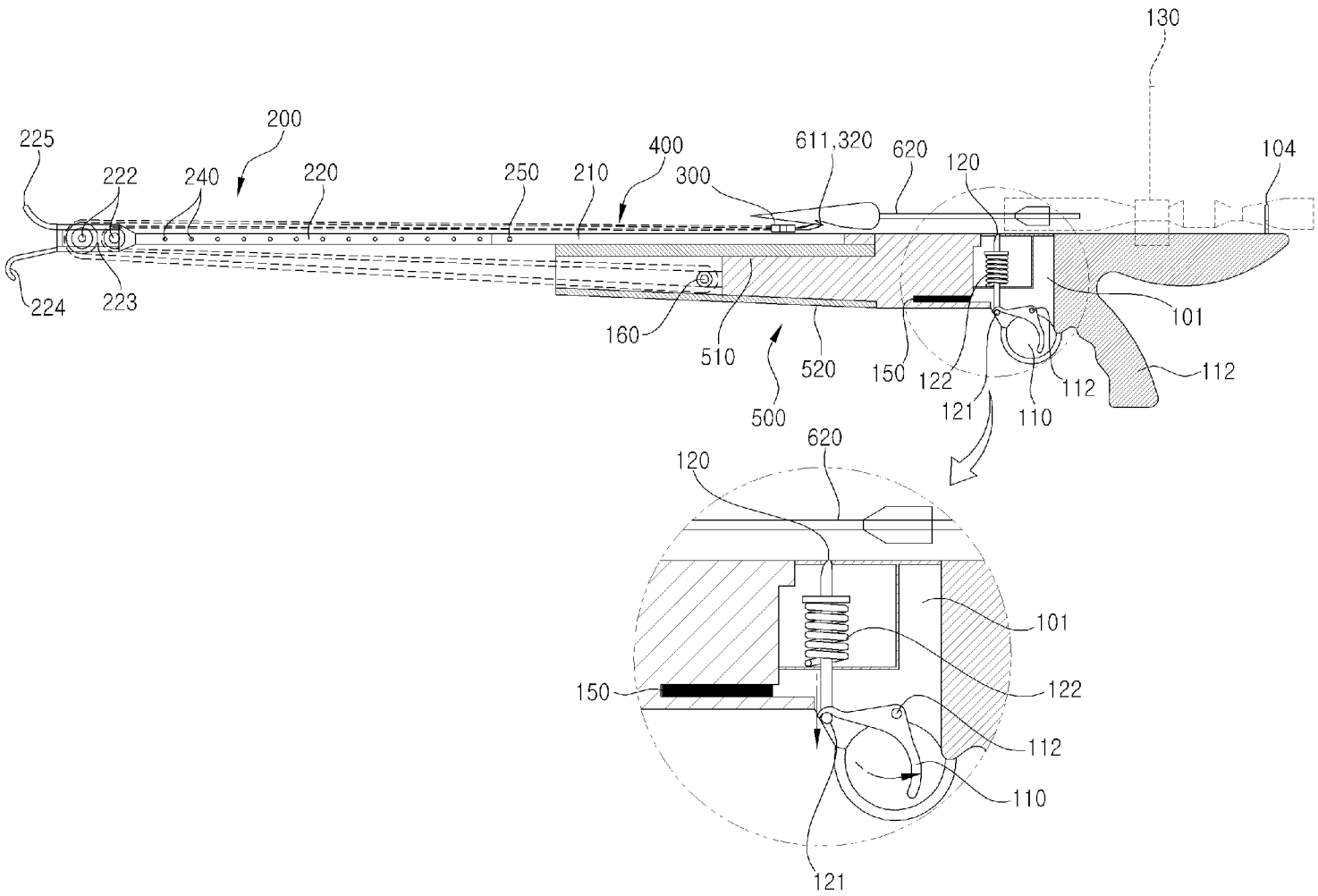

FIGS. 7 and 8 are diagrams illustrating the state in which the arrow of the improved crossbow in accordance with the first preferred embodiment of the present invention is fired.

In order for the crossbow 1 to perform firing, a user takes aim at a target at the front through the scope 140 combined with the body 100 of the crossbow 1.

As illustrated in FIG. 7, when the user pulls the trigger 110 backward around the trigger 110 combined with the lower part of the body 100, the trigger 110 rotatably moves around the hinge shaft 112 of the trigger 110 downward.

As illustrated in FIG. 8, the trigger 110 that rotatably moves downward functions to downward move the latch protrusion 120 combined with the coupling rings 111.

When the latch protrusion 120 moves downward by the operation of the trigger 110, the projectile 300 hung on the top of the latch protrusion 120 bounds forward through the tension of the bowstring 400 because the latching of the latch protrusion 120 has been released. At that time, the arrow 600 is fired forward because the latching strap 320 of the projectile 300 pulls the latching hook 611.

Figure 9:
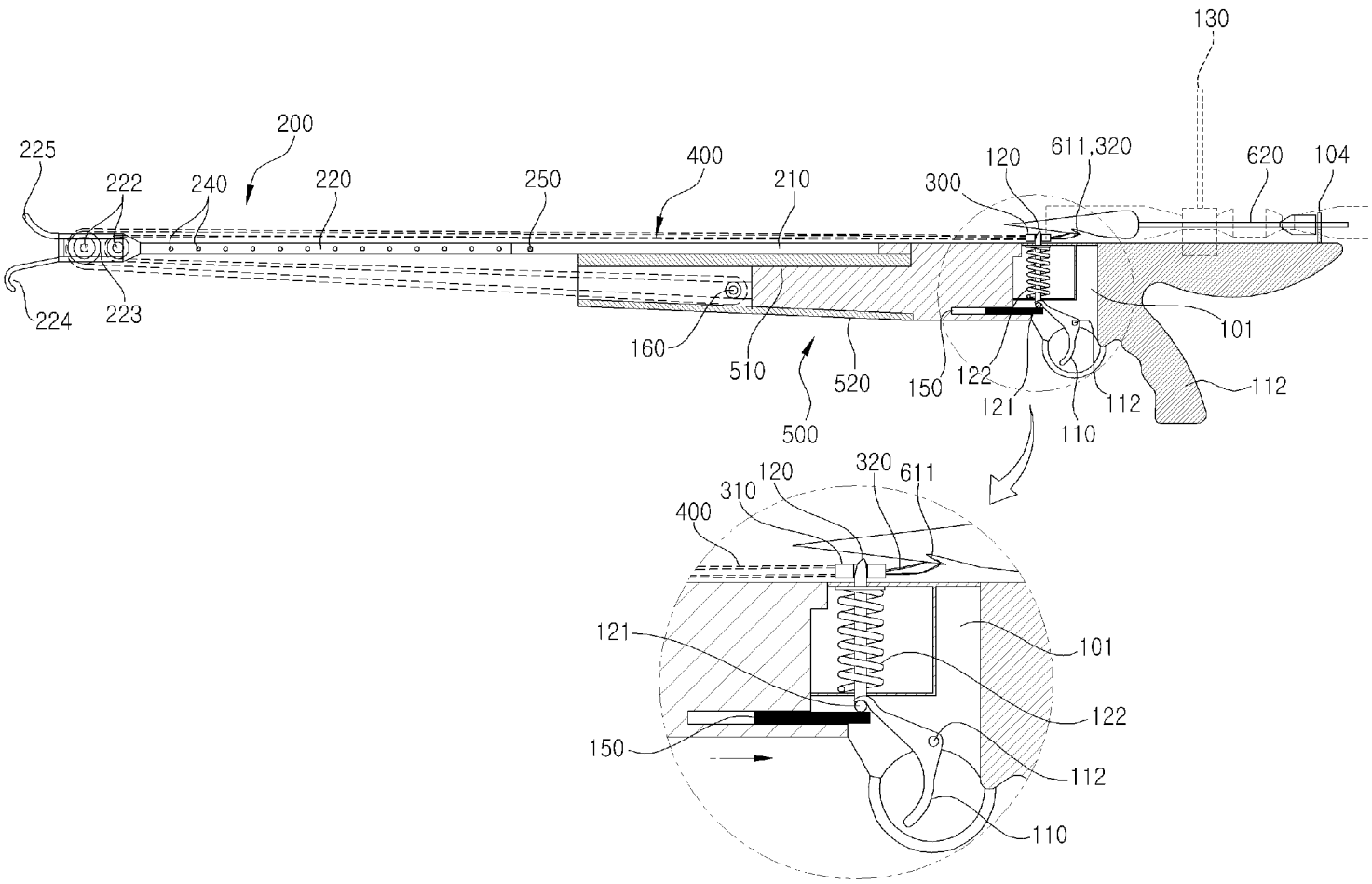
FIG. 9 is a diagram illustrating the state in which the safety device of the improved crossbow in accordance with the first preferred embodiment of the present invention has been driven.

FIG. 9 is a diagram illustrating the state in which a user has backward pulled the safety device 150 combined with one side of the lower part of the body 100 of the crossbow 1 when the crossbow 1 is not used.

That is, the safety device 150 slides backward within the body 100 and moves to the space to which the latch protrusion 120 comes down.

Accordingly, although a user unintentionally pulls the trigger 110, the crossbow 1 does not perform firing because the latch protrusion 120 clogged by the safety device 150 does not come down.

Figure 10:
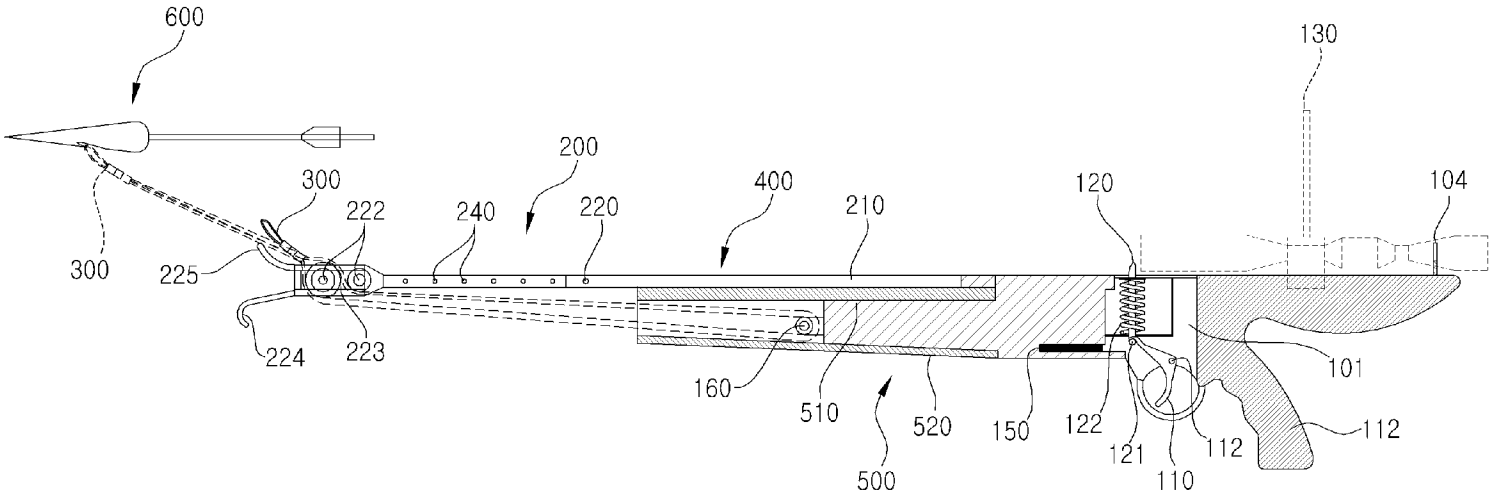
FIG. 10 is a diagram illustrating the state in which the arrow of the improved crossbow in accordance with the first preferred embodiment of the present invention has been fired.

FIG. 10 is a diagram illustrating the state in which the arrow 600 has been fully fired from the crossbow 1.

As illustrated in FIG. 10, the projectile 300 that bounces forward is hung on the guide ring 225 combined with the front of the control pipe 220 of the arrow track 200, thus not leaning to a downward direction.

That is, the guide ring 225 functions to prevent the latching strap 320 and the latching hook 611 from being downward rolled up in front of the roller coupling plates 223 due to the tension of the bowstring 400 although the latching strap 320 and the latching hook 611 are not separated when the projectile 300 bounces forward. The guide ring 225 guides the projectile 300 so that it continues to bounce toward the front of the roller coupling plates 223.

Accordingly, the latching strap 320 and the latching hook 611 are separated, and thus the arrow 600 flies toward a target aimed by a user.

Figure 12:
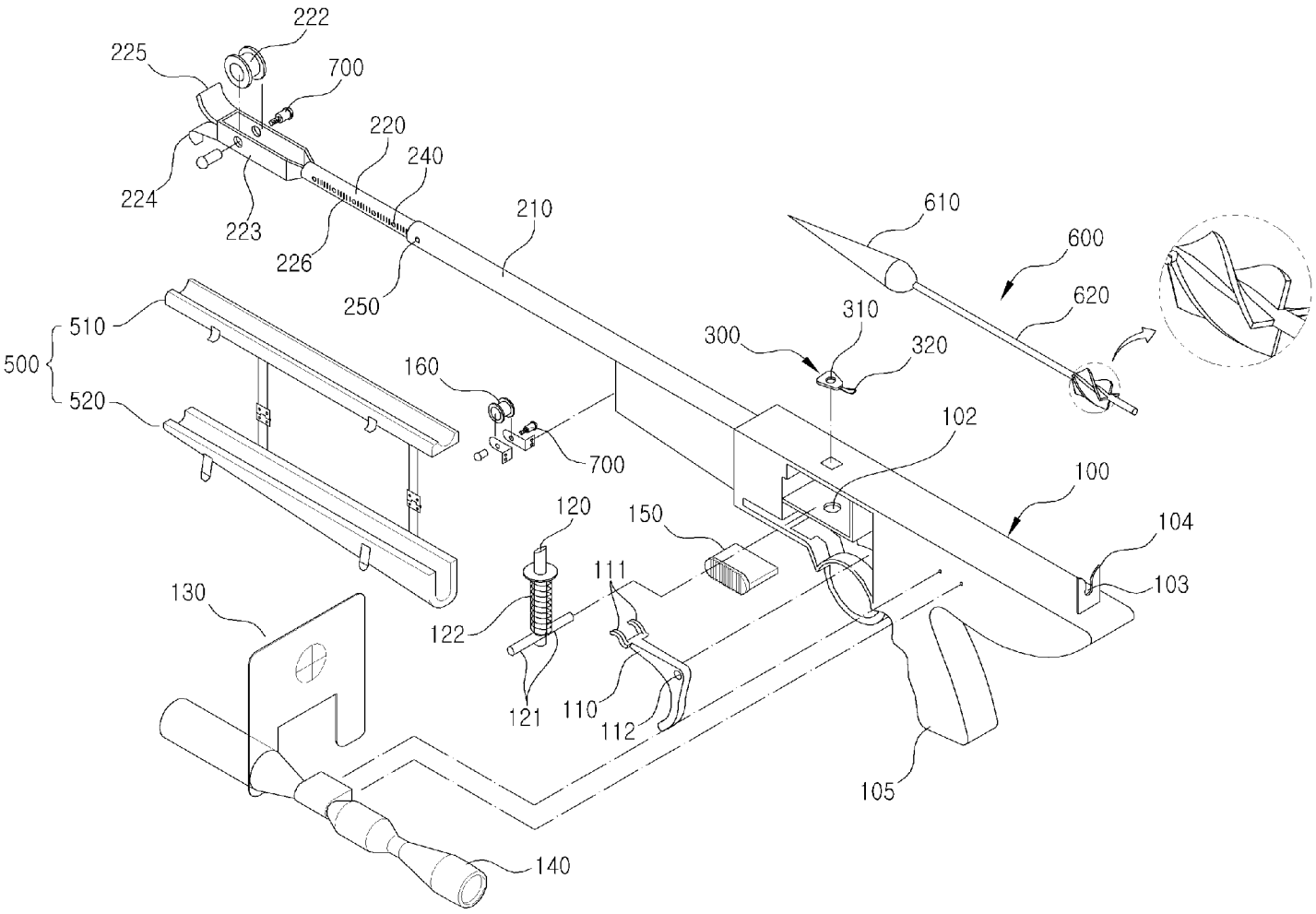
FIG. 12 is an exploded perspective view illustrating an improved crossbow in accordance with a second preferred embodiment of the present invention.
Figure 13:
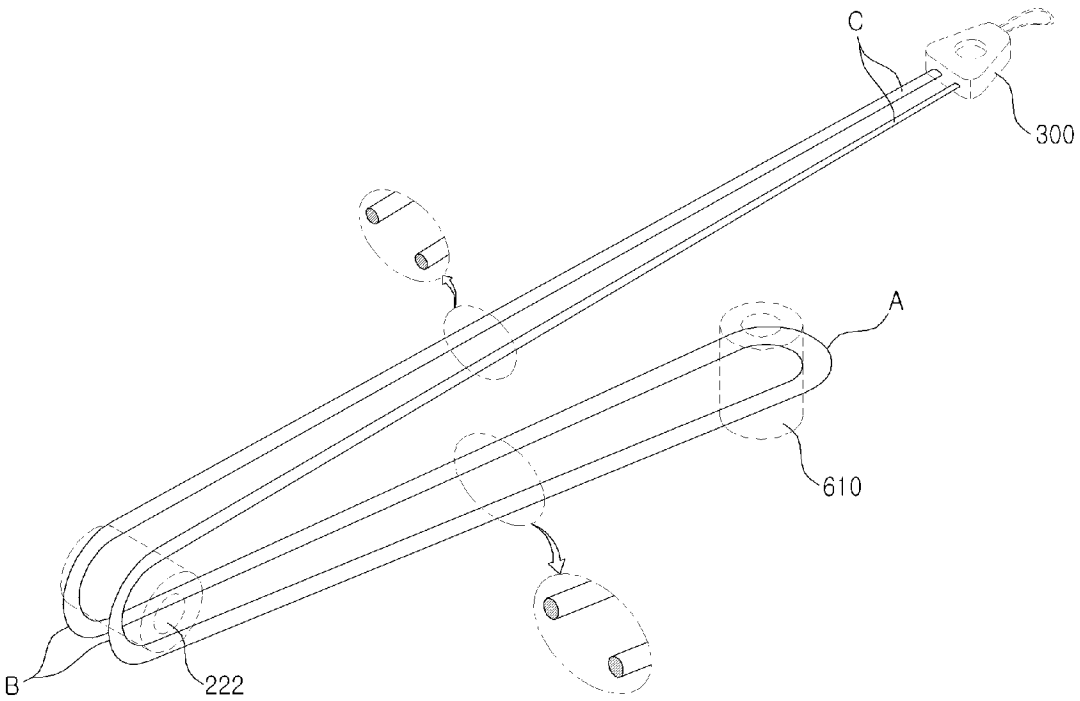
FIG. 13 is a perspective view illustrating the bowstring of the improved crossbow in accordance with the second preferred embodiment of the present invention.

FIG. 12 is an exploded perspective view illustrating an improved crossbow in accordance with a second preferred embodiment of the present invention. FIG. 13 is a perspective view illustrating the bowstring of the improved crossbow in accordance with the second preferred embodiment of the present invention.

Referring to FIGS. 12 and 13, the improved crossbow according to the second embodiment of the present invention is a crossbow in which a single front roller 222 is configured because the bowstring 400 is horizontally combined with the projectile 300 (refer to FIG. 13) when the bowstring 400 including two strings is combined with the projectile 300.

Furthermore, both the two strings of the bowstring 400 are extended on the front roller 222.

The remaining elements and operating states are the same as those of the first embodiment, and thus a detailed description thereof is omitted.

Those skilled in the art to which the present invention pertains will understand that the present invention may be implemented in other detailed forms without changing the technical spirit or indispensable characteristics of the present invention. Accordingly, it will be understood that the aforementioned embodiments are illustrative and not limitative from all aspects. The scope of the present invention is defined by the appended claims rather than the detailed description, and the present invention should be construed as covering all modifications or variations derived from the meaning and scope of the appended claims and their equivalents.

The invention claimed is:

1. An improved crossbow, comprising:

a body (100) which is formed in a gun form and in which a latch protrusion (120) connected to a trigger (110) and moved up and down is installed at a center within the body, the trigger (110) connected to the body through coupling shafts (121) protruded on both sides of a lower part of the latch protrusion (120) moves the latch protrusion (120) up and down, a handle (105) is integrated with the body in a rear of the trigger (110) and protruded from the body, and fixing rollers (160) are combined with ends of a front part of the trigger (110);

an arrow track (200) in which a fixing pipe (210) is inserted into an upper end of a front of the body (100) and combined with the body, a control pipe (220) is combined with the fixing pipe (210) so that the control pipe (220) slides within the fixing pipe (210) forward and backward, and a pair of front rollers (222) is combined with respective ends of a front part of the control pipe (220);

a projectile (300) in which a latching hole (310) is formed so that the projectile (300) is hung on the latch protrusion (120) of the body (100), a bowstring (400) is connected to a front of the projectile (300), and a latching strap (320) hung on a latching hook (611) formed in an arrowhead (610) of an arrow (600) is formed in a rear of the projectile (300); and the bowstring (400) which is combined with the fixing rollers (160) of the body (100) through the front rollers (222) of the arrow track (200) from the projectile (300) and which fires the projectile (300) toward the front of the body (100) when the trigger (110) works;

roller coupling plates (223) with which the front rollers (222) are combined are combined with a front of the control pipe (220) of the arrow track (200), and a guide ring (225) and a loading ring (224) are combined with respective upper and lower parts of front parts of the roller coupling plates (223), wherein the control pipe (220) comprises elastic members (230) having one ends combined with insertion holes (260) that are inserted into both sides of the control pipe (220) and formed in the control pipe (220) and elastic protrusions (240) combined with other ends of the elastic members (230) and elastically supported by the elastic members (230) so that the elastic protrusions (240) are inserted into the insertion holes (260) and externally protruded from the control pipe (220), fixing holes (250) into which the elastic protrusions (240) are inserted are formed to penetrate the fixing pipe (210) on both sides of the fixing pipe, and when the control pipe (220) slides within the fixing pipe (210), the elastic protrusions (240) are inserted into the fixing holes (250) and the control pipe (220) is fixed to the fixing pipe (210).

2. The improved crossbow of claim 1, wherein range control divisions (226) are formed on a side of the control pipe (220).

3. The improved crossbow of claim 1, wherein a loading plate (104) is combined with an upper part of a rear of the body (100) so that an arrow shaft (620) of the arrow (600) is inserted into the loading plate (104).

4. The improved crossbow of claim 1, wherein a safety device (150) is inserted into a lower part of the latch protrusion (120) of the body (100) and combined with the latch protrusion (120) in such a way as to operate within the body (100) backward and forward so that the safety device (150) blocks a space to which the latch protrusion (120) comes down and the latch protrusion (120) is prevented from moving downward.

5. The improved crossbow of claim 1, further comprising a protection plate (130) provided on one side of a side of the body (100) and upward bent from the body (100).

6. The improved crossbow of claim 5, wherein a scope (140) is fit into one side of a lower part of the protection plate (130) and combined with the protection plate (130).

7. The improved crossbow of claim 1, further comprising a cover plate (500) comprising an upper plate (510) and a lower plate (520) at a lower part of the fixing pipe (210) of the arrow track (200).

8. The improved crossbow of claim 1, wherein:

a coupling pin (700) having both ends separated is coupled with a center of the fixing rollers (160) and the front rollers (222), and the coupling pin (700) is fixed to the fixing rollers (160) and the front rollers (222) when the coupling pin (700) is dissembled and assembled through a spiral coupling method.

9. The improved crossbow of claim 1, wherein:

the bowstring (400) is divided into a first part (A), a second part (B), and a third part (C), the first part (A) is fixed to the fixing rollers (160), the second part (B) is extended on the front rollers (222), and the third part (C) is fixed to a front of the projectile (300) and combined with the projectile (300).

10. The improved crossbow of claim 9, wherein areas of the first part (A), the second part (B), and the third part (C) when the first, the second, and the third parts are cut in a vertical plane in a lengthwise direction of the bowstring (400) are fabricated to be different.

11. The improved crossbow of claim 10, wherein the bowstring (400) has a smaller area from the first part (A) to the third part (C).

* * * * *